US009233532B2

(12) United States Patent
Qiu et al.

(10) Patent No.: US 9,233,532 B2
(45) Date of Patent: Jan. 12, 2016

(54) INKJET RECORDING DEVICE AND PRINTING CONTROL METHOD OF SAME

(71) Applicant: Hitachi Industrial Equipment Systems Co., Ltd., Chiyoda-ku, Tokyo (JP)

(72) Inventors: An Qiu, Tokyo (JP); Takashi Kawano, Tokyo (JP); Tsuneaki Takagishi, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 14/418,095

(22) PCT Filed: May 28, 2013

(86) PCT No.: PCT/JP2013/064813
§ 371 (c)(1),
(2) Date: Jan. 29, 2015

(87) PCT Pub. No.: WO2014/020979
PCT Pub. Date: Feb. 6, 2014

(65) Prior Publication Data

US 2015/0165761 A1 Jun. 18, 2015

(30) Foreign Application Priority Data

Jul. 30, 2012 (JP) ..... 2012-168093

(51) Int. Cl.
*B41J 29/38* (2006.01)
*B41J 2/045* (2006.01)
(Continued)

(52) U.S. Cl.
CPC ..... *B41J 2/04576* (2013.01); *B05B 5/025* (2013.01); *B05B 5/08* (2013.01); *B05C 5/00* (2013.01); *B41J 2/01* (2013.01); *B41J 2/02* (2013.01); *B41J 2/075* (2013.01); *B41J 2002/022* (2013.01)

(58) Field of Classification Search
CPC .... B41J 2/115; B41J 2/04526; B41J 2/04573; B41J 2/09; B41J 2/095; B41J 19/14; B41J 2/01
USPC ..... 347/9, 16, 55, 74–77
See application file for complete search history.

(56) References Cited

U.S. PATENT DOCUMENTS 3,786,517 A 1/1974 Krause
7,310,812 B2 12/2007 Kato et al.
(Continued)

FOREIGN PATENT DOCUMENTS

JP 57-115357 A 7/1982
JP 2000-233504 A 8/2000
(Continued)

OTHER PUBLICATIONS

International Search Report (PCT/ISA/210) dated Aug. 13, 2013 with English-language translation (Five (5) pages).
(Continued)

*Primary Examiner* — An Do
(74) *Attorney, Agent, or Firm* — Crowell & Moring LLP

(57) ABSTRACT

Provided is an inkjet recording device for performing print control by increasing or decreasing the number of adjustment ink particles, which are used according to the speed of the object being printed even when the movement speed of the object being printed is increasing or decreasing and which are uncharged particles carrying a fixed electrical charge that takes electrostatic bonding into consideration. The present invention is an inkjet recording device provided with an ink container for holding ink that is to be printed on the object being printed, a nozzle that is connected to the ink container and discharges the ink, a charging electrode for charging specified ink that has been discharged from the nozzle, a deflecting electrode for deflecting the ink charged by said charging electrode, a gutter for collecting the ink that is not used for printing, and a control unit for controlling the printing. The inkjet recording device is characterized in that the control unit performs control so that ink particles which are not used for printing and are adjacent to ink particles that are used for printing are charged by the charging electrode.

20 Claims, 8 Drawing Sheets

(51) Int. Cl.

| | |
|---|---|
| ***B41J 2/02*** | (2006.01) |
| ***B05B 5/025*** | (2006.01) |
| ***B05B 5/08*** | (2006.01) |
| ***B05C 5/00*** | (2006.01) |
| ***B41J 2/01*** | (2006.01) |
| ***B41J 2/075*** | (2006.01) |

(56) References Cited

U.S. PATENT DOCUMENTS

| | | | | |
|---|---|---|---|---|
| 7,502,793 | B2 | 3/2009 | Snible et al. | |
| 8,136,900 | B2 * | 3/2012 | Iwasaki et al. | 347/5 |
| 8,974,029 | B2 * | 3/2015 | Qiu et al. | 347/14 |
| 8,974,041 | B2 * | 3/2015 | Boot et al. | 347/82 |
| 2010/0073411 | A1 | 3/2010 | Moriai et al. | |

FOREIGN PATENT DOCUMENTS

| | | | |
|---|---|---|---|
| JP | 2000-289208 | A | 10/2000 |
| WO | WO 2008/102458 | A1 | 8/2008 |

OTHER PUBLICATIONS

Corresponding Chinese Office Action dated Sep. 18, 2015 with English-language translation.

* cited by examiner

INKJET RECORDING DEVICE AND PRINTING CONTROL METHOD OF SAME

TECHNICAL FIELD

The present invention relates to an inkjet recording device and the printing control method of the same in which an ink particularized from the nozzle is continuously ejected.

BACKGROUND ART

As one of the prior art references relevant to the present invention, Patent Literature 1 (corresponding to International Application Publication No. WO2008/102458) is exemplified herein, which discloses 'A condition of the ink droplets is represented by a black filled circle and a triangle in relation to the electrification waveform, in which the black filled circle represents charged ink droplets to be used for the printing and the triangle represents the non-charged ink droplets which are not used for the printing. The non-charged ink droplets have a role containing that it becomes a blank domain of the matrix character to be printed and it adjusts a time period between the longitudinal dot columns. In either case, the electric charge is not applied to the ink droplets such that the formed ink droplets are collected at the gutter 15 without jumping out them from the head. A slow speed printing condition shown in FIG. 14 and FIG. 15 indicates that the speed of traveling the printing object is relatively slow in comparison with time when the ink droplets ejected from the nozzle 11 are arranged on the printing object 19 in a predetermined number of pieces. For this reason, it is necessary to adjust time from printing termination of the preceding longitudinal dot column to printing start of the succeeding longitudinal dot column. The non-charged droplets of $\alpha$ pieces which are not printed are added, as a used amount, to the respective longitudinal dot columns of the matrix character containing four lines, each of which is made up of longitudinal Y dots which is a column of printed dots made up of the ink droplets of Y pieces. In the case of FIG. 15, the seven pieces of non-charged ink droplets, which are not printed out, are added to five pieces of the ink droplets to be used actually for the printing, which is handled as longitudinal dot columns, in relation to the matrix character made up of longitudinal five dots and transverse four lines'.

CITATION LIST

Patent Literature

PTL 1: International Application Publication No. WO02008/102458

SUMMARY OF INVENTION

Technical Problem

As mentioned above, according to the disclosure of Patent Literature 1, ink-jet printing (IJP) is performed with non-charged ink particles for adjustment inserted between charged ink particles. At this time, when negatively charged ink particles ejected from the nozzle pass through the deflecting electrode, the ink particles are deflected to the positive side of the deflecting electrode by electrostatic attraction so as to be printed on the printing object. However, there are some cases where such non-charged ink particles for adjustment might be electrostatically bonded to the negatively charged ink particles adjoining to such non-charged ink particles for adjustment, so that such non-charged ink particles for adjustment are positively charged. The problem with such cases lies in the fact that the ink particles for adjustment are deflected to the negative side of the deflecting electrode when they pass through the deflecting electrode so that they do not return to the gutter.

Further, according to the disclosure of Patent Literature 1, the total number of ink particles for one longitudinal column is determined through the method by which non-charged particles are inserted between charged particles (hereinafter, referred to as 'the rate by which particles are used). At this time, as long as the conveying speed of the printing object is at a certain rate and there is a predetermined number of ink particles containing non-charged particles to be used for printing, theoretically, the interval between longitudinal columns results in being constantly the same as a result of ink-jet printing (IJP). However, when the conveying speed of the printing object changes, it is natural that such interval between the longitudinal columns subjected to ink-jet printing (IJP) changes.

In Patent Literature 1, only the case where the conveying speed of the printing object is at a certain rate is taken into account, but the situation where the travelling speed of the printing object accelerates or decelerates between the printing object detection sensor and the nozzle is not taken into due account, with the result that it is likely that such interval between longitudinal columns subjected to ink-jet printing (IJP) might fluctuate.

The present invention is to solve the abovementioned problem and to improve on printing quality as well as reliability with printing operation.

Solution to Problem

In order to solve such problem, the arrangements recited in the accompanying patent claims are adopted herein by way of some examples. The present invention contains a plurality of means to solve such problem, but one of them is presented as follows: an inkjet recording device comprising: an ink container for holding ink that is printed on a printing object; a nozzle that is connected to the ink container and discharges the ink; a charging electrode for charging a specified portion of the ink discharged from the nozzle; a deflecting electrode for deflecting the ink charged at the charging electrode; a gutter that collects the ink that is not used for printing; and a control unit that controls the printing, in which the control unit is characterized in controlling the ink particles that are adjoining to the ink particles used for the printing and are not used for the printing such that they are charged with the charging electrode.

Advantageous Effects of Invention

The present invention allows an inkjet recording device that improves on printing quality as well as reliability with printing operation to be provided.

DESCRIPTION OF EMBODIMENTS

The preferred examples for carrying out the present invention are described below with reference to the accompanying drawings.

(First Embodiment)

Figure 1:
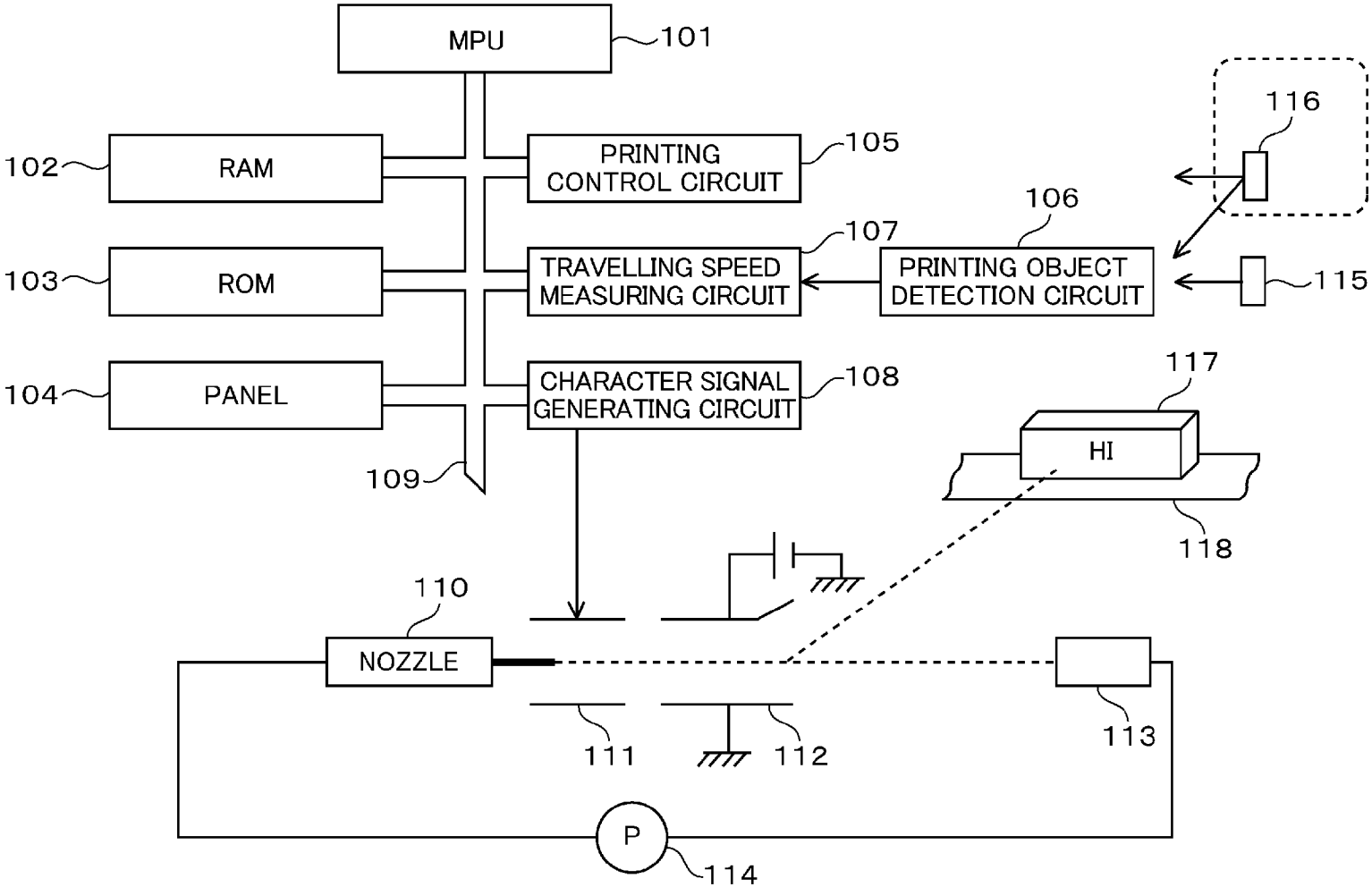
FIG. 1 shows a structural arrangement of an inkjet recording device according to first and second embodiments of the present invention.

In FIG. 1, the structural arrangement of the inkjet recording device according to the present example is shown, in which 101 denotes an MPU (Micro Processing Unit) to control the inkjet recording device as a whole, 102 denotes a RAM (Random Access Memory) to temporarily store data within the inkjet recording device, 103 denotes a ROM (Read Only Memory) to store software and data to compute a belt conveyor speed and a printing speed, 104 denotes a panel in which the length of a printing object, a printing distance, a position to start with writing and a width between columns in which characters are printed are input, 105 denotes a printing control circuit to control the printing operation of the inkjet recording device, 106 denotes a printing object detection circuit, 107 denotes a travelling speed measuring circuit to compute a belt conveyor speed based on the time required to detect the printing object and the input length of the printing object, 108 denotes a character signal generating circuit to render a printing content into a character signal, 109 denotes a bus to transmit data and so forth, 110 denotes a nozzle to eject the ink, 111 denotes a charging electrode to charge the ink particles derived from the ink ejected from the nozzle, 112 denotes a deflecting electrode to deflect the charged ink particles, 113 denotes a gutter to collect the ink that is not used for the printing, 114 denotes a pump to refeed the ink collected from the gutter to the nozzle, 115 and 116 denote sensors to detect the printing object, 117 denotes a printing object on which the printing is performed and 118 denotes a belt conveyor to carry the printing object thereon.

Then, a series of operations from imputing a printing content to completing the printing is explained as follows. The printing content can be set by inputting its data through the panel 104 so as to be preserved in the RAM 102. Further, the total number of ink particles for one longitudinal column can be calculated with the following equation 1 based on the size of character to be printed, the width between columns in which characters are printed and the rate by which the ink particles are used that are input and set by the panel 104.

Total Number of Ink Particles for One Longitudinal Column=(Longitudinal Number of Dots in Character+Width between Columns) multiplied by Rate by which Ink Particles are Used (Equation 1)

The printing time (T) per one longitudinal column can be calculated with the following equation 2 based on the calculated total number of ink particles for one longitudinal column and the cycle of the generated ink particles.

Printing Time per One Longitudinal Column=Total Number of Ink Particles for One Longitudinal Column/Exciting Frequency (Equation 2)

The maximum printing speed V can be calculated with the following equation 3 based on the calculated printing time per one longitudinal column and the distance between longitudinal columns (hereinafter, referred to as 'dot pitch').

Maximum Printing Speed V=Dot Pitch/Printing Time per One Longitudinal Column (Equation 3)

Figure 3:
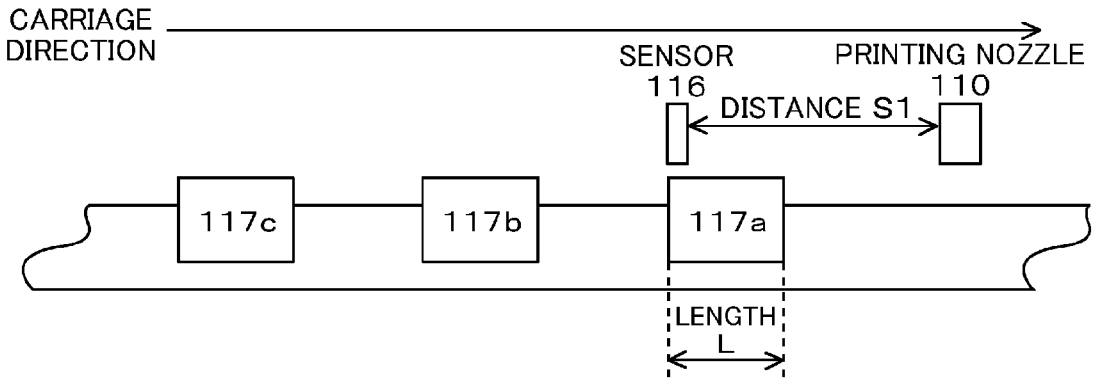
FIG. 3 is a view showing the state where printing objects are carried when one printing object detection sensor is adopted for the inkjet recording device according to a first embodiment of the present invention.
Figure 6:
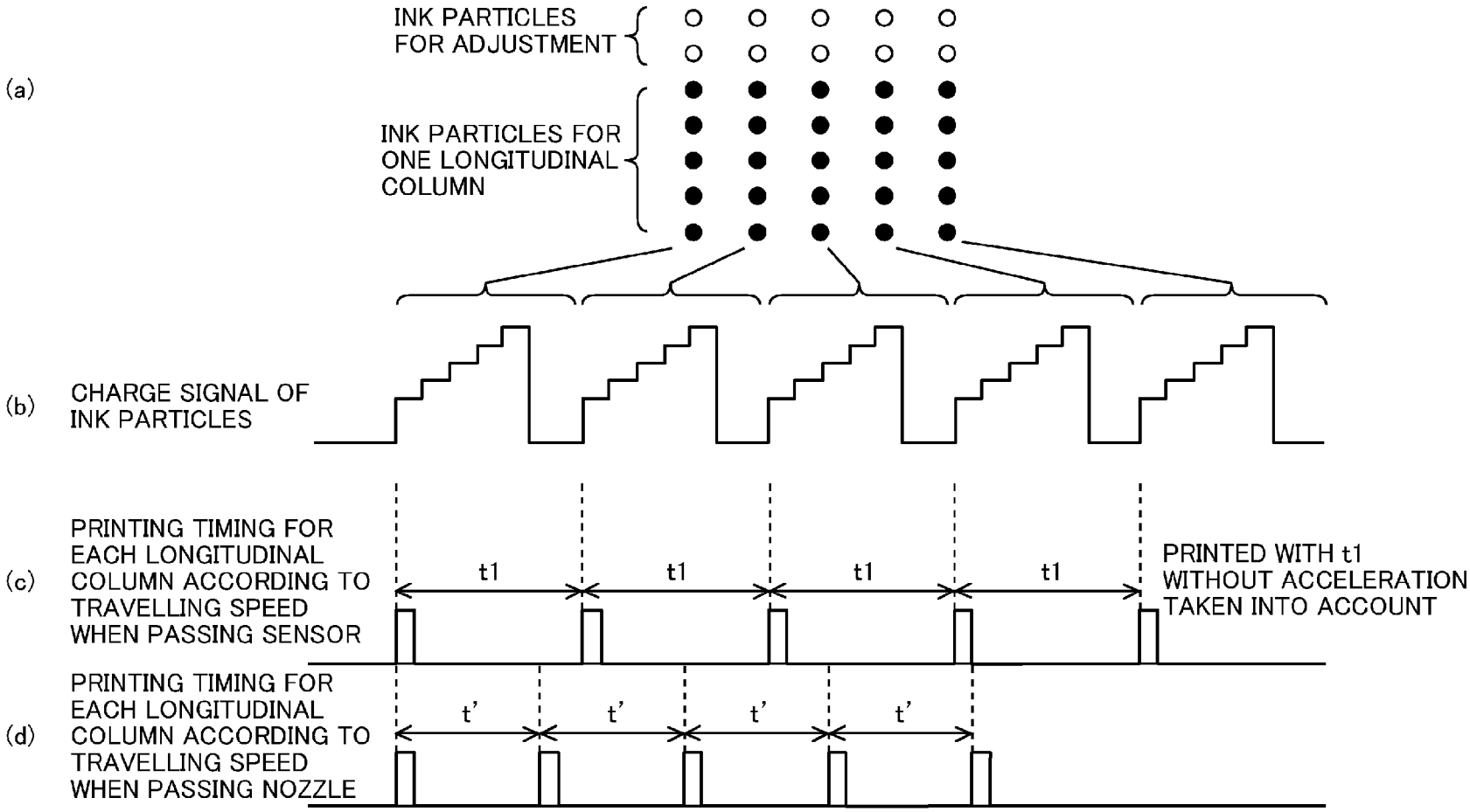
FIG. 6A-6D are views showing the relationship between the ink particles for adjustment and those for each longitudinal column to be charged according to the carrying speed of the printing object in the prior art.
Figure 7:
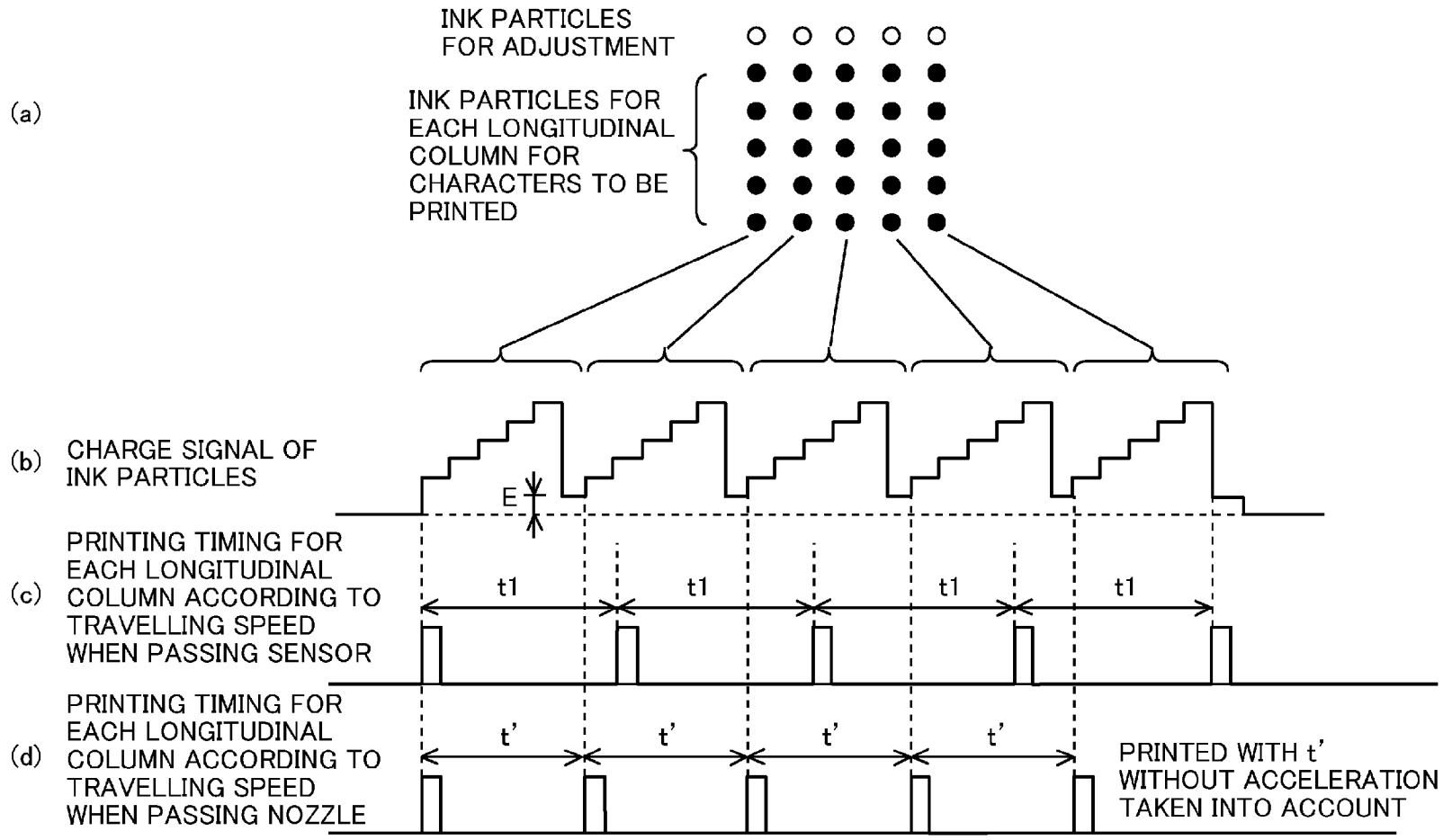
FIG. 7A-7D are views showing the relationship between the ink particles for adjustment and those for each longitudinal column to be charged according to the carrying speed of the printing object based on the present invention.
Figure 8:
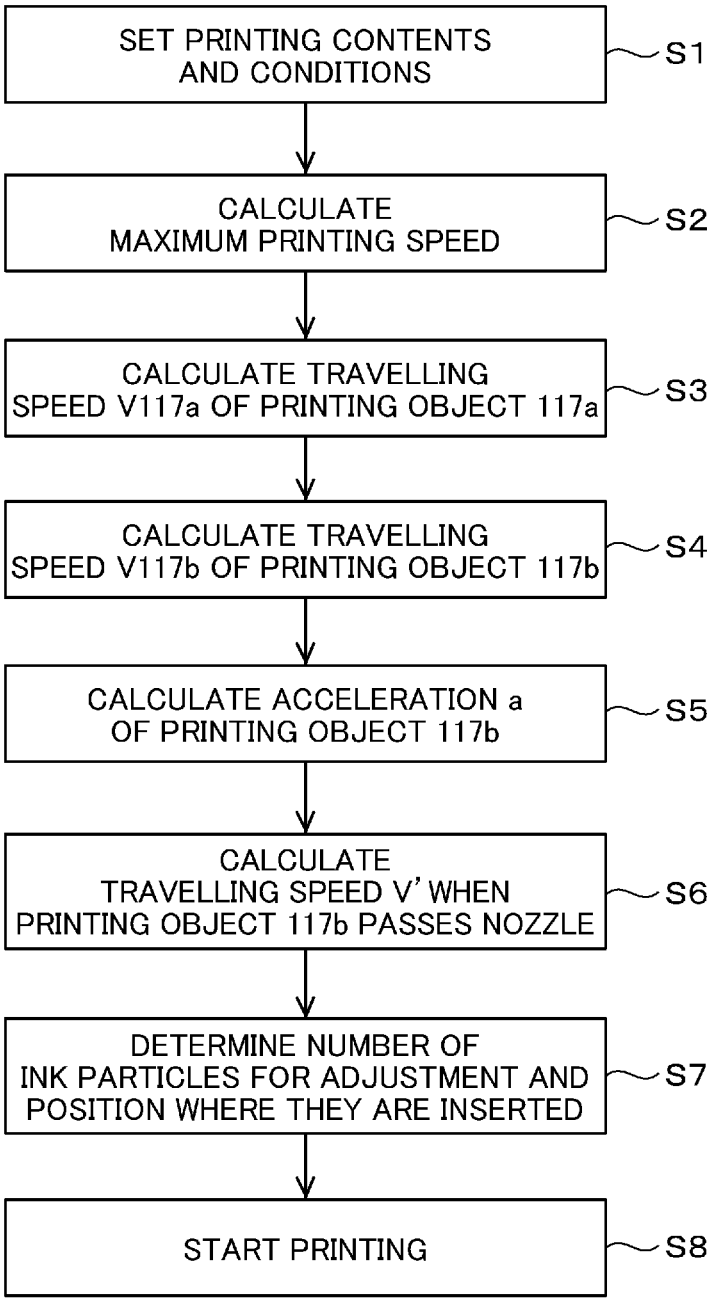
FIG. 8 is a flow chart showing how to control the printing according to the first embodiment of the present invention.

Then, with reference to FIGS. 3, 6 and 8, the difference between the prior art and the present invention is explained. FIG. 3 is a view showing the state where printing objects are carried when one printing object detection sensor is adopted for the inkjet recording device according to the present example whereas FIG. 6 is a view showing the relationship between the ink particles for adjustment and those for each longitudinal column to be charged according to the carrying speed of the printing object in the prior art. FIG. 7 is a view showing the relationship between the ink particles for adjustment and those for each longitudinal column to be charged according to the carrying speed of the printing object based on the present invention while FIG. 8 is a flow chart showing how to control the printing according to the present example.

FIG. 3 is a view showing the printing objects carried when one printing object detection sensor is adopted according to the first embodiment. As shown in FIG. 3, the printing object 117*a* is carried on the foremost position of the belt conveyor and the other printing objects 117*b* and 117*c* follow with a certain interval between them on the conveyor. Then, herein, the length in the carriage direction of the printing object is defined as L; and the distance from the printing object detection sensor 116 to the printing nozzle 110 is defined as S1. The present invention is intended for calculating the number of ink particles for one longitudinal column, the printing time, the travelling speed and acceleration of the printing objects and setting the number of ink particles for adjustment as well as performing the printing by the time when the printing objects travel from the printing object detection sensor 116 to the printing nozzle 110 and before the printing nozzle starts operating.

Hereupon, to begin with, the relevant prior art is explained with reference to FIG. 6. FIG. 6 shows the relationship between the ink particles to adjust the width between columns in which characters are printed and the charged ink particles for printing the characters according to the conveying speed of the printing object. In FIG. 6, FIG. 6(*a*) shows a dot pattern of the ink particles for each longitudinal column for printing the character and a dot pattern of the ink particles to adjust the width between columns in which characters are printed; FIG. 6(*b*) shows a charge signal of ink particles corresponding to such dot patterns; FIG. 6(*c*) shows a printing timing signal for each longitudinal column according to the travelling speed of the printing object when it passes the printing object detection sensor 116; and FIG. 6(*d*) shows a printing timing signal for each longitudinal column according to the travelling speed of the printing object when it passes the printing nozzle 110.

With reference to FIGS. 6(*a*) and 6(*b*), as with the ink particles (five black filled circles) for one longitudinal column and those for adjustment (two white filled circles) at the left side as shown in FIG. 6(*a*), seeing the charge signal (its vertical axis indicating the charge voltage) shown in FIG. 6(*b*), it is found that the charge voltage of the lower dots to be printed is lower while such voltage gradually rises and two dots of the ink particles for adjustment determine the width with the subsequent longitudinal column. FIGS. 6(*a*) and 6(*b*) show dot patterns in which five vertical lines are printed. As with the printing timing shown in FIG. 6(*c*), the printing is performed at a certain time t1 without any acceleration arising when the printing object travels on the conveyor being taken into account. Thus, the printing timing corresponds to the pulse rising time of the charge signal of the ink particles shown in FIG. 6(*b*). However, as shown in FIG. 6(*d*), when acceleration arising when the printing object travels on the conveyor is taken into account, the cycle t' of the printing timing for each longitudinal column according to the travelling speed of the printing object when it passes the printing nozzle is displaced with the cycle of the charge signal of the ink particles shown in FIG. 6(*b*).

Accordingly, when the printing is performed, there arises slight inconsistency in the width between the columns in which characters are printed, so that the printing quality slightly deteriorates. Further, as shown in FIG. 6, according to the travelling speed of the printing object which passes the printing object detection sensor, the number of non-charged ink particles for adjustment to be inserted is determined, but in the case where the printing object 117*a* travels with acceleration during the lapse of time from when it passes the printing object detection sensor 116 to when it passes the printing nozzle 110, such number of non-charged ink particles for adjustment has not been able to be altered in the prior art. Further, on account that the ink particles for adjustment are non-charged, when there exist charged ink particles in front of the inserted ink particles for adjustment, electrostatic bonding with the charged ink particles deprives electric charge of the non-charged ink particles for adjustment, so that when the ink particles for adjustment pass the deflecting electrode, such particles are deflected to the negative side of the deflecting electrode, with the result that they cling to the surroundings without returning to the gutter.

Then, how to control the printing with the acceleration of the printing object taken into account which is yet to be solved by the prior art is explained as follows. FIG. 8 is a flow chart showing how to control the printing according to the present example. With reference to FIG. 8, in the first place, at S1, such printing contents and conditions as the type of characters to be printed, their size and the width between the columns in which they are printed are set. Then, at S2, the maximum printing speed is calculated with the equations 1, 2 and 3 based on the predetermined values. Subsequently, at S3 and S4, based on the length of the respective printing objects and the time during which the printing objects shield the light emitted from the detection sensor 116, the travelling speeds V117*a* and V117*b* of the printing objects 117*a* and 117*b* when they pass the printing object detection sensor 116 are calculated. At S5, based on the travelling speeds of the first and second printing objects 117*a* and 117*b* and the difference t1 in timing in which those two printing objects are detected, the acceleration a of the printing object 117*b* is calculated with the following equation 4.

$$\text{Acceleration } a=(V117a-V117b)/t1 \qquad \text{(Equation 4)}$$

Then, at S6, the following equations 5 and 6 are established correlatively among the calculated acceleration a of the printing object 117*b*, the conveying speed V117*b* when the printing object 117*b* passes the printing object detection sensor 116 and the distance S1 between the sensor and the nozzle body 110, according to which the travelling speed V' when the printing object 117*b* passes the nozzle body 110 is calculable.

$$S1=V117b\times t+0.5\times at^2 \qquad \text{(Equation 5)}$$

$$V'=V117b+at \qquad \text{(Equation 6)}$$

Then, the number of ink particles for adjustment that are inserted or required according to the conveying speed V' when the printing object 117*b* passes the nozzle body 110 is found by calculating the following equation 7.

$$\text{Travelling Speed } V'=\text{Exciting Frequency}\times\text{Dot Pitch}/(\text{Total Number of Ink Particles for One Longitudinal Column}+\text{Number of Ink Particles for Adjustment})\times\text{Rate by which Ink Particles are used} \qquad \text{(Equation 7)}$$

Through the above calculation, the number of ink particles for adjustment calculated with the above equation 7 is determined.

Further, the ink particles for adjustment are inserted following the insertion of the predetermined ink particles for one longitudinal column, in which when there exist charged ink particles in front of those for adjustment, the ink particles for adjustment are electrified with a certain amount of electric charge of lower level according to the electric charge amount with which the ink particles in front of those for adjustment are charged (S7). Electrifying the ink particles for adjustment with such electric charge of lower level allows electric charge amount to be set off between the ink particles for adjustment and the charged ink particles to be used for the printing positioned in front of the ink particles for adjustment even when there might arise electrostatic bonding between them, so that the ink particles for adjustment are rendered substantially into a non-charged state, with the result that the ink particles for adjustment are not deflected by the deflecting electrode or they are securely collected by the gutter. Then, the charged ink particles for the printing start printing according to their charge voltage (S7).

Subsequently, the printing on the printing object according to the abovementioned printing control method is explained as follows with reference to FIG. 7. FIG. 7 shows how to control the printing with the acceleration of the printing object taken into account, in details, showing the relationship between the ink particles for adjustment and the charged ink particles to be printed according to the travelling speed of the belt conveyor. With reference to FIG. 7, FIG. 7(*a*) shows a dot pattern of the ink particles for each longitudinal column for characters to be printed and a dot pattern of the ink particles to adjust a width between the columns in which the characters are printed; FIG. 7(*b*) shows the charge signals of the ink particles according to such dot patterns; FIG. 7(*c*) shows the printing timing signal for each longitudinal column according to the travelling speed of the printing object when it passes the printing object detection sensor 116; and FIG. 7(*d*) shows the printing timing signal for each longitudinal column according to the travelling speed of the printing object when it passes the printing nozzle 110. FIG. 7(*a*) shows an example of dot patterns of the ink particles, in which it is exemplified that the printing according to such dot patterns make five vertical lines printed. The charge signals of the ink particles corresponding to the example shown in FIG. 7(*a*) are shown in FIG. 7(*b*).

The dot pattern of the ink particles for one longitudinal column at the left side of FIG. 7(*a*) corresponds to the charge signal of the ink particles at the left side of FIG. 7(*b*), in which the charge voltage of the lowest printing dot is lower while such voltage rises according as the printing dots go upwards. Then, when the printing at the fifth dot ends, there is one dot for the ink particles for adjustment, the number of which particles corresponds to the calculated number. Further, one dot of such ink particles for adjustment corresponds to the interval with the subsequent character (vertical line herein). Moreover, the charge voltage E is slightly applied to the ink particles for adjustment so as to make them electrified. This prevents the ink particles for adjustment from being not collected into the gutter, which is caused by the ink particles for adjustment being slightly electrified through electrostatic bonding with the charged ink particles when there exist such charged ink particles in front of the ink particles for adjustment. That is to say, against the charge voltage with which the ink particles for adjustment are electrified under the influence of the charged ink particles in front of them, those for adjustment are electrified with an opposite electric charge having the counterbalancing voltage, so that the electric charge of the ink particles for adjustment is rendered into zero so as to make them collected at the gutter.

Then, FIG. 7(*c*) shows a printing timing signal for each longitudinal column according to the travelling speed of the printing object when it passes the printing object detection sensor, in which any acceleration of the printing object when the conveyor moves is not taken into account, so that such printing timing signal does not correspond to the timing of the charge signal of ink particles shown in FIG. 7(*b*). On the other hand, the printing timing signal for each longitudinal column according to the conveying speed of the printing object when it passes the printing nozzle shown in FIG. 7(*d*) corresponds to the timing of the charge signal of the ink particles shown in FIG. 7(*b*) due to the fact that the acceleration of the printing object is taken into account when the conveyor moves. As mentioned above, according to the present invention, the printing quality enhances further than the prior art in such a manner that the printing is performed by calculating the acceleration of the printing object when the conveyor moves and the number of ink particles for adjustment to determine the width between the columns in which characters are printed based on the travelling speeds and so forth. Further, in the prior at, when there exist charged ink particles for the characters to be printed in front of those for adjustment or there exist those for adjustment after such charged particles, those for adjustment are slightly electrified by electrostatic bonding with such charged particles, so that they are not collected into the gutter. Enforcedly electrifying those for adjustment allows the electric charge amount to be set off between those for adjustment and such charged particles, so that the collectability with which those for adjustment are collected improves so as to permit the reliability with the printing operation to enhance.

(Second Embodiment)

Figure 4:
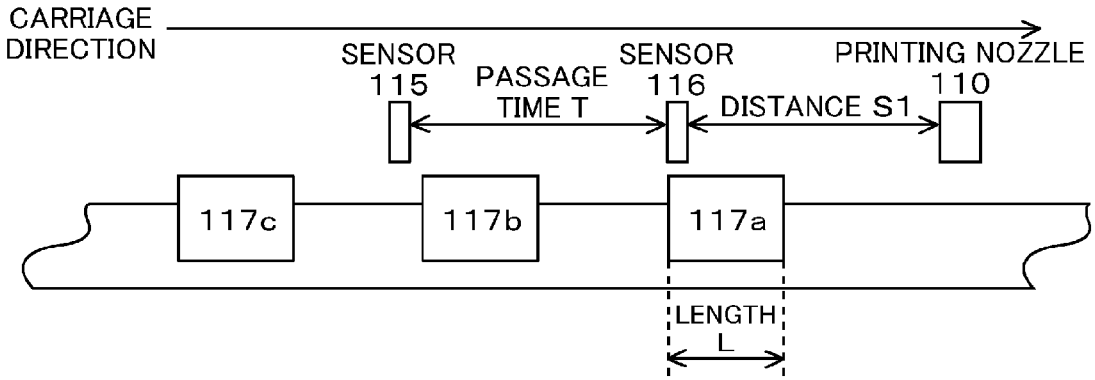
FIG. 4 is a view showing the state where printing objects are carried when two printing object detection sensors are adopted for the inkjet recording device according to the second embodiment of the present invention.

Then, the carriage of the printing objects where two printing object detection sensors are provided according to the present invention is explained with reference to FIG. 4. In FIG. 4, it is shown that the printing object detection sensors 115 and 116 are disposed with a certain interval between them; and on the conveyor the printing object 117*a* is carried in the forefront thereof and the printing object 117*b* is disposed with a certain interval with the printing object 117*a* as well as the printing object 117*c* is further disposed with a certain interval with the printing object 117*b*. Further, herein, the length of the printing objects in the carriage course to which they are carried is defined as L while it is defined that the printing objects pass for the passage time T between the printing object detection sensors. Moreover, herein, the distance from the printing object detection sensor 116 to the printing nozzle 110 is defined as S1.

Figure 9:
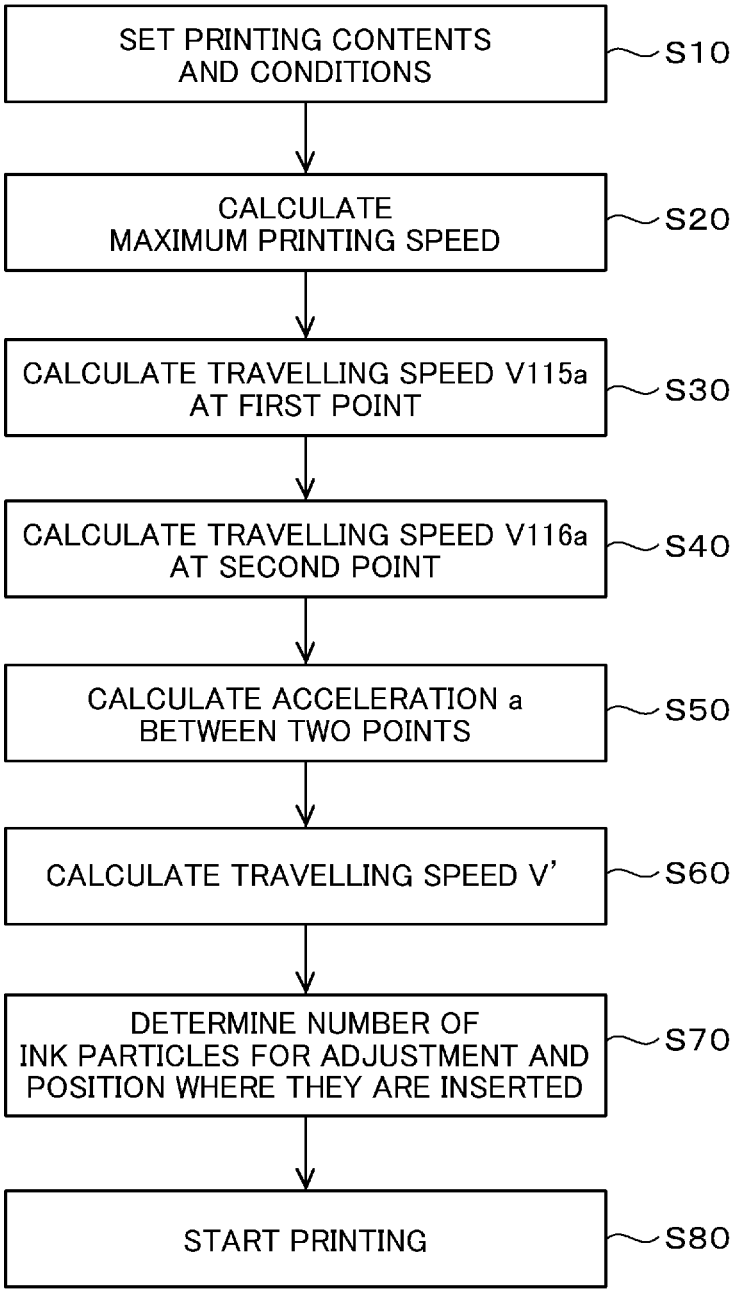
FIG. 9 is a flow chart showing how to control the printing according to the second embodiment of the present invention.

How to control the printing according to the present example is explained as follows with reference to the flow chart illustrated in FIG. 9. First of all, such printing contents and conditions as the type of characters to be printed, their size and the width between the columns in which characters are printed are set (S10). Then, the maximum printing speed is calculated with the following equations 1 to 3 based on the predetermined values (S20). Then, the travelling speeds V115*a* and V115*b* of the printing object 117*a* at the first point (at the detection sensor 115) and the second point (at the detection sensor 116) are calculated based on the length of the printing object and the time during which the printing object 117*a* shields the light emitted from the detection sensors 115 and 116 (S30, S40), and the acceleration a of the printing object 117*a* is found with the following equation 8 based on the passage time t1 during which the printing object passes between those two detection sensors (S50).

$$\text{Acceleration } a=(V116a-V115a)/t1 \qquad \text{(Equation 8)}$$

The travelling speed V' of the printing object 117*a* when it passes the printing nozzle 110 is calculable with the following equations 9 and 10 based on the calculated acceleration a of the printing object 117*a*, the travelling speed V116*a* of the printing object when it passes the printing object detection sensor 116 and the distance S1 between the detection sensor 116 and the printing nozzle 110.

$$S1=V116a\times t+0.5\ at^2 \qquad \text{(Equation 9)}$$

$$V'=V116a+at \qquad \text{(Equation 10)}$$

Then, the number of ink particles for adjustment that are inserted and required according to the travelling speed V' of the printing object 117*a* when it passes the nozzle 110 is calculable with the following equation 11.

$$\text{Travelling Speed } V'=\text{Exciting Frequency}\times\text{Dot Pitch}/(\text{Total Number of Ink Particles for One Longitudinal Column}+\text{Number of Ink Particles for Adjustment})\times\text{Rate by which Ink Particles are used} \qquad \text{(Equation 11)}$$

Through the above calculation, the number of ink particles calculated with the above equation 11 is determined.

Further, the ink particles for adjustment are inserted following the insertion of the predetermined ink particles for one longitudinal column, in which when there exist charged ink particles in front of those for adjustment, the ink particles for adjustment are electrified with a certain amount of electric charge according to the electric charge amount with which the ink particles in front of those for adjustment are charged (S70). Then, the charged ink particles for the printing start printing according to their charge voltage (S80).

Using two printing object detection sensors according to the above arrangement permits the acceleration of the printing object and the travelling speed of the printing object when it passes the printing nozzle to be calculated, in which the printing can be controlled in such a manner that the number of ink particles for adjustment, which are electrified with a certain amount of electric charge with electrostatic bonding with the charged ink particles additionally applied to the non-charged ink particles to be used according to the travelling speed of the printing object when it passes the printing nozzle, is increased or decreased. Thereby, the printing quality and the reliability with the printing operation enhance.

(Third Embodiment)

Figure 5:
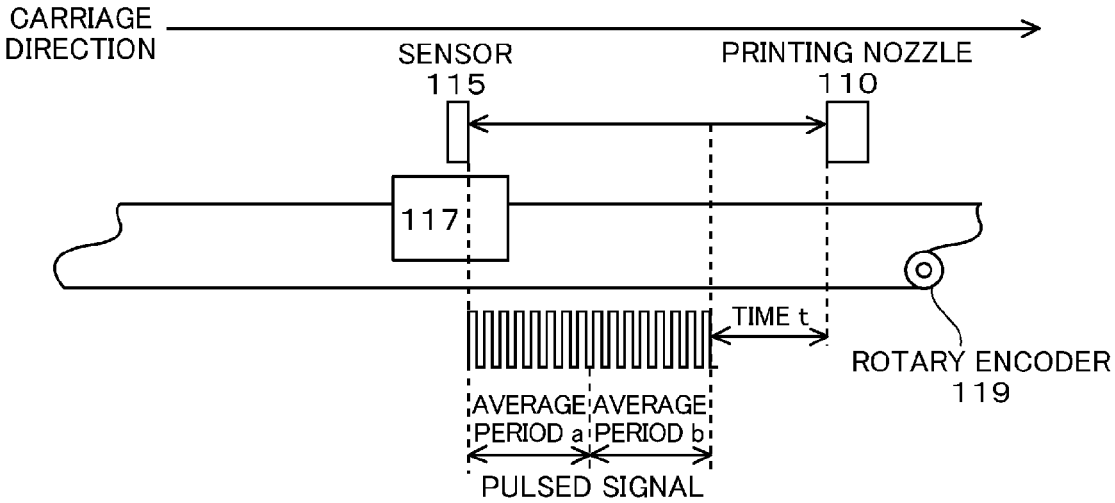
FIG. 5 is a view showing the state where the printing object is carried when a rotary encoder is adopted for the inkjet recording device according to the third example of the present invention.

Then, the carriage of the printing object according to the present example in which such printing object is carried on the production line provided with a rotary encoder is explained as follows with reference to FIG. 5. In FIG. 5, after the printing object 117 is detected at the printing object detection sensor 115, its travelling speed as well as its average periods a and b are calculated based on the predetermined pulse number and pitch between pulses of the rotary encoder 119 that are input from the encoder. As for how to find the travelling speed and acceleration of the printing object based on such average periods and how to find the number of ink particles for adjustment as required, it is described afterwards.

Figure 2:
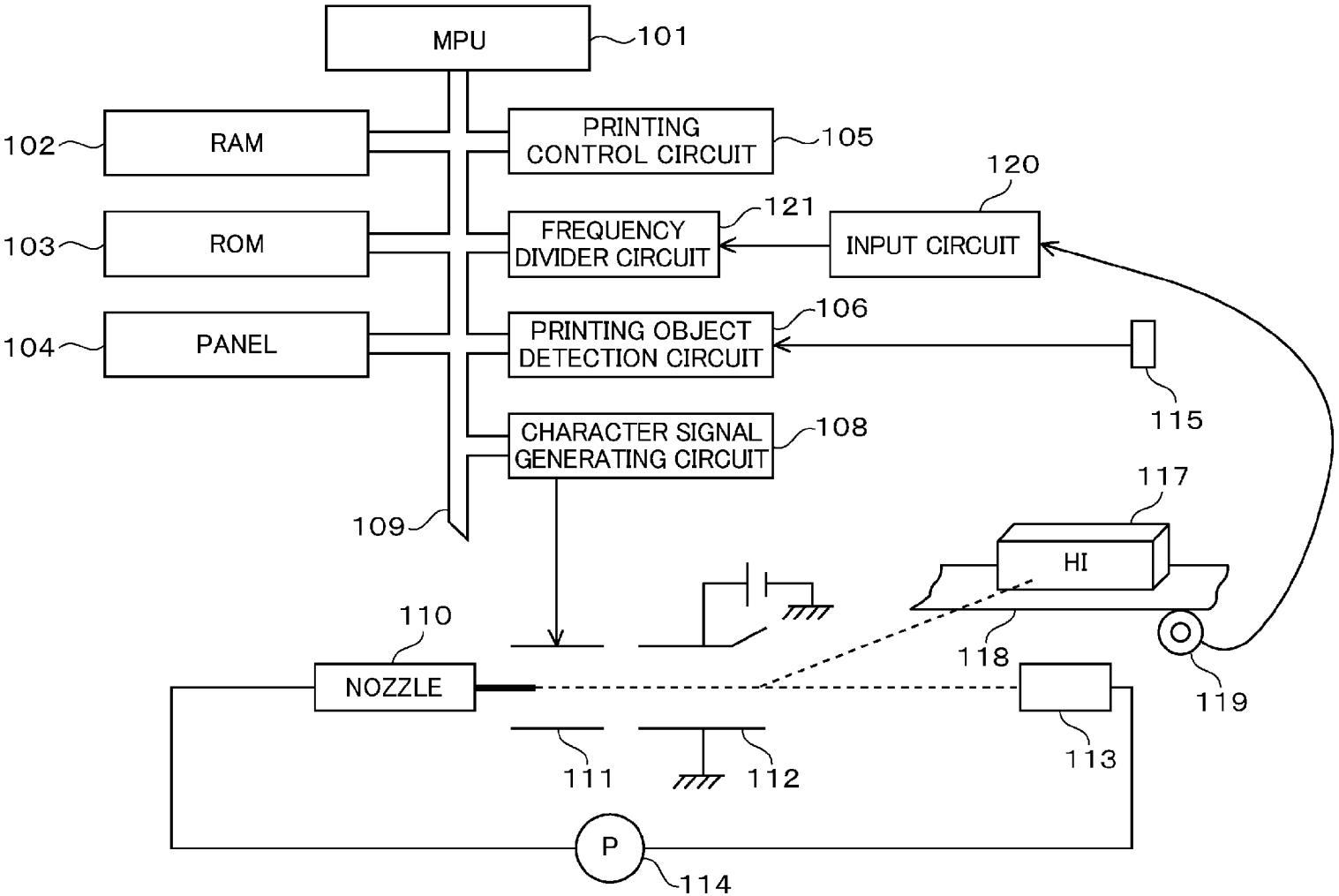
FIG. 2 shows a structural arrangement of an inkjet recording device according to a third embodiment of the present invention.

The structural arrangement of the inkjet recording device, in which the rotary encoder 119 according to the present example is provided, is shown in FIG. 2. With reference to FIG. 2, the same structural components as those shown in FIG. 1 are numbered with the same reference numerals as those shown in FIG. 1 and explanation is given below on the components differentiating the present example from that shown in FIG. 1. Namely, in FIG. 2, 115 denotes a sensor to detect a printing object; 117 denotes the printing object on which the printing is performed; 118 denotes a belt conveyor to carry the printing object 117; 119 denotes a rotary encoder disposed on the belt conveyor 119 to convert the movement of the belt conveyor into a pulse number; 120 denotes an input circuit of a pulsed signal of the rotary encoder 119; and 121 denotes a frequency divider to demultiply the pulsed signal of the rotary encoder are illustrated.

Figure 10:
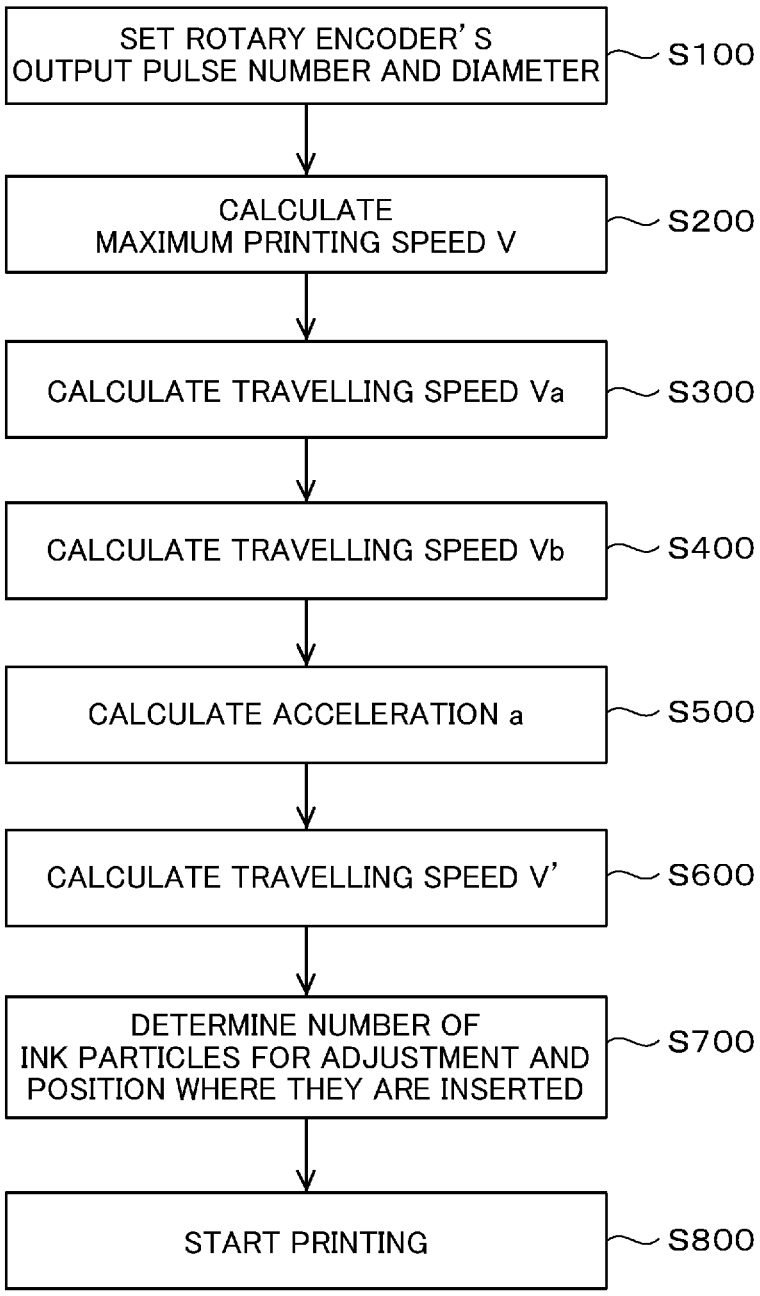
FIG. 10 is a flow chart showing how to control the printing according to the third embodiment of the present invention.

Then, how to control the printing according to the third embodiment is explained as follows with reference to the flow chart shown in FIG. 10. In the first place, the printing contents desired to be printed and the printing conditions in harmony with carriage speed as well as the rotary encoder's output pulse number when it revolves once and the diameter of the encoder pulley are preliminarily set through the panel 104 so as to be preserved in RAM 102 (S100). At this time, the pitch between encoder pulses is calculable based on such output pulse number and diameter of the encoder pulley. Based on the printing size, the rate by which ink particles are used, the width between the columns in which characters are printed, the number of dots for each longitudinal column to be used for the printing is calculable with the following equation 12.

Total Number of Ink Particles for One Longitudinal Column=(Longitudinal Number of Dots in Character+Width between Columns) multiplied by Rate by which Ink Particles are Used (Equation 12)

Based on the calculated total number of ink particles for one longitudinal column and the cycle of the generated number of ink particles, the printing time T per one longitudinal column is calculable with the following equation 13.

Printing Time per One Longitudinal Column=Total Number of Ink Particles for One Longitudinal Column/Exciting Frequency (Equation 13)

The maximum printing speed V can be calculated with the following equation 14 based on the calculated printing time per one longitudinal column and the dot pitch (S200).

Maximum Printing Speed $V$=Dot Pitch/Printing Time per One Longitudinal Column (Equation 14)

Upon the printing object being carried on the production line provided with the rotary encoder (see FIG. 5), after the printing object is detected at the printing object detection sensor, its travelling speed as well as its average periods a and b are calculated based on the predetermined pulse number and pitch between encoder pulses of the rotary encoder 119 that are input from the encoder. Based on the calculated average periods, the conveying speed Va (S300) is calculable with the following equation 15 while the conveying speed Vb (S400) is calculable with the following equation 16.

Travelling Speed $Va$=Travelling Distance/Average Period $a$×Pulse Number (Equation 15)

Travelling Speed $Vb$=Travelling Distance/Average Period $b$×Pulse Number (Equation 16)

Based on the measured difference in speed between the travelling speeds Va and Vb of the printing object 117, the acceleration a (at s500) of the printing object 117 is calculable with the following equation 17 using such difference and time measured by the rotary encoder 119.

Acceleration $a$=($Vb$−$Va$)/(Average Period $a$+Average Period $b$)×Pulse Number (Equation 17)

Based on the acceleration a of the printing object 117, the travelling speed Vb derived from the calculated period b and the time t at which the printing object reaches the printing nozzle 110, the travelling speed V' of the printing object 117 when it passes the nozzle 110 is calculable with the following equation 18 (S600).

$$V'=V\,b+a\,t \quad \text{(Equation 18)}$$

Then, the number of ink particles for adjustment as required according to the travelling speed V' of the printing object 117 when it passes the nozzle 110 is calculable with the following equation 19.

Travelling Speed $V'$=Exciting Frequency×Dot Pitch/(Total Number of Ink Particles for One Longitudinal Column+Number of Ink Particles for Adjustment)×Rate by which Ink Particles are used (Equation 19)

Through the above calculation with the equation 19, the number of ink particulates for adjustment is determined. Further, the ink particles for adjustment are inserted following the insertion of the predetermined ink particles for one longitudinal column, in which when there exist charged ink particles in front of those for adjustment, the ink particles for adjustment are electrified with a certain amount of electric charge according to the electric charge amount with which the ink particles in front of those for adjustment are charged (S700). Then, the ink particles for adjustment start printing according to their charge voltage (S800).

Using the rotary encoder according to the above arrangement permits the acceleration of the printing object and the travelling speed of the printing object when it passes the printing nozzle to be calculated, in which the printing can be controlled in such a manner that the number of ink particles for adjustment, which are electrified with a certain amount of electric charge with electrostatic bonding with the charged ink particles additionally applied to the non-charged ink particles to be used according to the travelling speed of the printing object when it passes the printing nozzle, is increased or decreased. Thereby, the printing quality and the reliability with the printing operation enhance.

REFERENCE SIGNS LIST

101: MPU (Micro Processing Unit)
102: RAM (Random Memory Access Memory)
103: ROM (Read Only Memory)
104: panel
105: printing control circuit
106: printing object detection circuit

107: travelling speed measuring circuit
108: character signal generating circuit
109: bus
110: nozzle
111: charging electrode
112: deflecting electrode
113: gutter
114: pump
115, 116: printing object detection sensor
117: printing object
118: belt conveyor
119: rotary encoder
120: input circuit of pulsed signal of rotary encoder
121: frequency divider of pulsed signal of rotary encoder

The invention claimed is:

1. An inkjet recording device comprising:

an ink container for holding ink that is printed on a printing object;

a nozzle that is connected to the ink container and discharges the ink;

a charging electrode for charging a specified portion of the ink discharged from the nozzle;

a deflecting electrode for deflecting the ink charged at the charging electrode;

a gutter that collects the ink that is not used for printing; and a control unit that controls the printing;

wherein at the control unit it is controlled such that the ink particles that are adjoining to the ink particles used for the printing and are not used for the printing are charged with the charging electrode; and wherein at the control unit it is controlled such that a travelling speed of the printing object is calculated when the printing object passes the nozzle based on acceleration of the printing object; the number of ink particles that are not used for the printing according to the travelling speed is calculated; and the printing is performed with a total number of ink particles using the calculated number of ink particles not used for the printing and the number of ink particles used in a specified manner for the printing.

2. The inkjet recording device according to claim 1 comprising:

a plurality of detection sections to detect passage time of the printing object at a reference position of the printing object; and a travelling speed measuring circuit to calculate the travelling speed of the printing object, wherein a first travelling speed of the printing object at a first point is calculated based on detection information from a first detection section; a second travelling speed of the printing object at a second point is calculated based on detection information from a second detection section; and the acceleration of the printing object is calculated based on the first and second travelling speeds and time required for the printing object to pass a distance between the first and second points.

3. The inkjet recording device according to claim 2, wherein each of the detection sections includes a sensor to detect the printing object and the passage time of the printing object.

4. The inkjet recording device according to claim 2, wherein each of the detection sections includes an encoder to generate signals according to a travel of the printing object.

5. The inkjet recording device according to claim 1 comprising:

a detection section to detect passage time of the printing object at a reference position of the printing object; and:

a travelling speed measuring circuit to calculate the travelling speed of the printing object, wherein the travelling speed at a prescribed point of another printing object positioned forward in a carriage direction of the printing object and the travelling speed of the printing object at the prescribed point of the printing object are calculated based on detection information from the detection section; and the acceleration of the printing object is calculated based on the travelling speeds of the printing object and the other printing object at the prescribed point and a difference in time between when the other printing object reaches the prescribed point and when the printing object reaches the prescribed point.

6. The inkjet recording device according to claim 5, wherein the detection section includes a sensor to detect the printing object and the passage time of the printing object.

7. The inkjet recording device according to claim 5, wherein the detection section includes an encoder to generate signals according to a travel of the printing object.

8. The inkjet recording device according to claim 1, further comprising a travelling speed measuring circuit to calculate the travelling speed of the printing object, wherein the travelling speed of the printing object is calculated when the printing object passes the nozzle;

the number of ink particles for adjustment and a position where the ink particles for adjustment are inserted are determined according to the travelling speed; and when there exist charged ink particles in front of the ink particles to be inserted for adjustment, the ink particles for adjustment are preliminarily electrified with a certain amount of electric charge on account that the electric charge of the ink particles for adjustment is ruined through electrostatic boding with the charged ink particles in front of them when the ink particles for adjustment are generated.

9. The inkjet recording device according to claim 8, further comprising a detection section including a sensor to detect the printing object and the passage time of the printing object.

10. The inkjet recording device according to claim 8, further comprising a detection section including an encoder to generate signals according to a travel of the printing object.

11. A printing control method of an inkjet recording device including an ink container for holding ink that is printed on a printing object; a nozzle that is connected to the ink container and discharges the ink; a charging electrode for charging a specified portion of the ink discharged from the nozzle; a deflecting electrode for deflecting the ink charged at the charging electrode; a gutter that collects the ink that is not used for printing; and a control unit, the printing control method comprising:

controlling the printing such that the ink particles that are adjoining to the ink particles used for the printing and are not used for the printing are charged with the charging electrode;

controlling the printing such that a travelling speed of the printing object is calculated when the printing object passes the nozzle based on acceleration of the printing object;

calculating the number of ink particles that are not used for the printing according to the travelling speed; and performing the printing with a total number of ink particles using the calculated number of ink particles not used for the printing and the number of ink particles used in a specified manner for the printing.

12. The printing control method of the inkjet recording device according to claim 11, wherein the inkjet recording device further includes:

a plurality of detection sections to detect passage time of the printing object at a reference position of the printing object; and a travelling speed measuring circuit to calculate the travelling speed of the printing object, the printing control method further comprising:

calculating a first travelling speed of the printing object at a first point based on detection information from a first detection section;

calculating a second travelling speed of the printing object at a second point based on detection information from a second detection section; and calculating the acceleration of the printing object based on the first and second travelling speeds and time required for the printing object to pass a distance between the first and second points.

13. The printing control method of the inkjet recording device according to claim 12, wherein each of the detection sections includes a sensor to detect the printing object and the passage time of the printing object.

14. The printing control method of the inkjet recording device according to claim 12, wherein each of the detection sections includes an encoder to generate signals according to a travel of the printing object.

15. The printing control method of the inkjet recording device according to claim 11, wherein the inkjet recording device further includes:

a detection section to detect passage time of the printing object at a reference position of the printing object; and a travelling speed measuring circuit to calculate the travelling speed of the printing object, the printing control method further comprising:

calculating the travelling speed at a prescribed point of another printing object positioned forward in a carriage direction of the printing object and the travelling speed of the printing object at the prescribed point of the printing object based on detection information from the detection section; and calculating the acceleration of the printing object based on the travelling speeds of the printing object and the other printing object at the prescribed point and a difference in time between when the other printing object reaches the prescribed point and when the printing object reaches the prescribed point.

16. The printing control method of the inkjet recording device according to claim 15, wherein the detection section includes a sensor to detect the printing object and the passage time of the printing object.

17. The printing control method of the inkjet recording device according to claim 15, wherein the detection section includes an encoder to generate signals according to a travel of the printing object.

18. The printing control method of the inkjet recording device according to claim 11, wherein the inkjet recording device further includes a travelling speed measuring circuit to calculate the travelling speed of the printing object, wherein the travelling speed of the printing object is calculated when the printing object passes the nozzle;

wherein the number of ink particles for adjustment and a position where the ink particles for adjustment are inserted are determined according to the travelling speed; and wherein when there exist charged ink particles in front of the ink particles to be inserted for adjustment, the ink particles for adjustment are preliminarily electrified with a certain amount of electric charge on account that the electric charge of the ink particles for adjustment is ruined through electrostatic boding with the charged ink particles in front of them when the ink particles for adjustment are generated.

19. The printing control method of the inkjet recording device according to claim 18, wherein the inkjet recording device further includes a detection section including a sensor to detect the printing object and the passage time of the printing object.

20. The printing control method of the inkjet recording device according to claim 18, wherein the inkjet recording device further includes a detection section including an encoder to generate signals according to a travel of the printing object.

* * * * *